United States Patent [19]

Piana

[11] 4,193,230

[45] Mar. 18, 1980

[54] COVERING FOR BUILDING STRUCTURES AND RELATED INSTALLATION METHOD

[76] Inventor: Renato Piana, Corso Tintori 19, Florence, Italy

[21] Appl. No.: 905,977

[22] Filed: May 15, 1978

[51] Int. Cl.[2] ..... E04B 1/10; E04B 1/38

[52] U.S. Cl. ..... 52/90; 52/285; 52/387; 52/489; 52/509; 52/778

[58] Field of Search ..... 52/480, 778, 509, 512, 52/90, 506, 408, 409, 542, 519, 537, 538, 18, 387, 285, 489

[56] References Cited

U.S. PATENT DOCUMENTS

| | | | |
|---|---|---|---|
| 650,939 | 6/1900 | Kasch | 52/519 |
| 1,920,490 | 8/1933 | Tracy | 52/519 |
| 2,031,680 | 2/1936 | Tuthill | 52/387 |
| 2,834,305 | 5/1958 | Dean | 52/519 |
| 2,924,963 | 2/1960 | Taylor | 52/509 |
| 3,447,823 | 6/1969 | Gregoire | 52/90 |

*Primary Examiner*—John E. Murtagh
*Attorney, Agent, or Firm*—Harold L. Stowell

[57] ABSTRACT

The cover consists of rods 10–12, arranged perpendicularly to each other, to retain shaped plates B1 showing, next to the longitudinal edges thereof, coupling members 30, 34, 35, as well as anchoring members 24, 25, 50.

Plates B1 are designed to retain coating blocks for pavements made of wood or of other materials, which are retained to plates B1 by means of tongue-and groove connections.

13 Claims, 2 Drawing Figures

COVERING FOR BUILDING STRUCTURES AND RELATED INSTALLATION METHOD

The present invention relates to a covering for roofs, ceilings, floors and the like, comprising mutually couplable elements as connected to the frame of the considered structure; the invention also relates to the method for installing said elements.

The main object of the present invention is to provide a covering and in general a lining for roofs and walls which is easily to install and able to well resist against inclement weather and moreover is economically competitive.

In particular the present invention aims to provide a covering which, while of light weight, is resistant against the mechanical stresses, in particular the wind, and is able to completely prevent infiltrations from occurring even in the case of remarkable preciptations.

Another object of the present invention is to allow for the use, in the covering making, of synthetic materials and in particular of extruded resins suitable for the specific applications of said coverings, in such a way as to protect said coverings against aging and atmospheric agents, thereby the realized covering fully exploits the properties and the characteristics of the resins without presenting the drawbacks of these latter.

Another object of the invention is to provide covering and lining elements able to be specifically designed according to the needs, in which the exposed surfaces or faces, especially when subjected to the weather, are suitably protected. For example said exposed surfaces or faces may be made of any material effective to resist against wear, especially in the case in which the covering according to the invention forms terraces or other similar covering.

The covering according to the present invention, consisting of elements mutually couplable and able to be connected to the supporting frame of the considered structure, is characterized by a plurality of parallely located plates, extending from the bottom to the top of the roof or wall structure and provided, at least along a portion of the longitudinal edges thereof, with means for a mutual connecting and a tight closing with the adjacent strips and with holding means, preferably of the fixed-joint type extending as a ridge along the longitudinal edges of said plates for holding covering bodies.

This concept is practically susceptible to several embodiments all failing within the scope of the present invention. For example, the plates are advantageously made of extruded resins and said plates are fixed to the supporting frame by suitable anchoring members and are protected against the atmospheric agents, in particular sun and hail, by covering bodies held by said plates. These covering bodies may be made of materials resisting against the atmospheric agents such as metallic materials (aluminium and alloys thereof), cement materials (asbestos-cement and conglomerates), and suitably processed wood material.

In an advantageous embodiment of the covering, the plates advantageously made of extruded resins are provided, along the longitudinal edges thereof, with fins, in part horizontally extending and in part slanted, located in such a way as to mutually cooperate and delimitate fixed joint slots and engage the holding members anchoring said plates to the structure frame, at least a portion of the slanted fins of one of said plate engaging, in a face-to-face relationship, complementary slanted fins of the plate adjacent to the considered plate in order to provide for the mechanical connecting between said plates and tightness against the atmospheric agents.

According to the present invention said plates are provided with fin pairs, at an upper level with respect to the longitudinal edges thereof, the element of which being opposingly located to resiliently engage slots provided by the pheripheral opposed walls of the covering bodies to fix these latter to the supporting frame. Again with respect to the tightness and the connecting or coupling of the plates of the covering, at least a portion of the slanted fins consists of pairs the elements of which are spaced from one another to provide slots whereinto are fixedly inserted the slanted fins of the plates adjacent to the considered plate.

The method for making the described covering is characterized by the steps of locating the plates on the covering supporting frame structure, by abutting to one another the longitudinal slanted fins of the two adjacent plates; inserting the anchoring members in the slots formed by the edges of the complanary fins of said adjacent plates, engaging the arms opposed to said members with said coplanar fin edges; then fixing to the frame supporting structure said anchoring members, thereby exercising on the two adjacent considered plates forces effective to clamp said plates in order to bring said plates nearer to one another and clamp said plates to said structure; then resiliently forcing in the abutments delimitated by said raised horizontal fins the covering bodies and tightly closing the slots formed between said bodies.

The invention will be illustrated by the following detailed description with reference to the accompanying drawing showing, as an example only, a roof covering according to the present invention.

The illustrated covering is suitably held by a supporting frame A, formed, in a known way, by beams 10 and 12 perpendicularly located to one another and fixed to the structure of the considered building to form the two roof flaps held at the top of the roof by an intermediate beam.

The covering B according to the present invention consists of plates B1 of suitable size and the length of which, as will be described hereinbelow, may suitably and remarkably vary with respect to the width thereof. This is to meet the requirements of the single coverings to be made. Advantageously the plates B1 are made of extruded plastics materials, of strip shape and a rather great length, from which said plates are cut. Depending on the use requirements and in the considered case, the plates B1 extend from the bottom to the top of the roof in such a manner that the ends of said plates are located one at the gutter and the other at the top of the roof.

Figure 1:
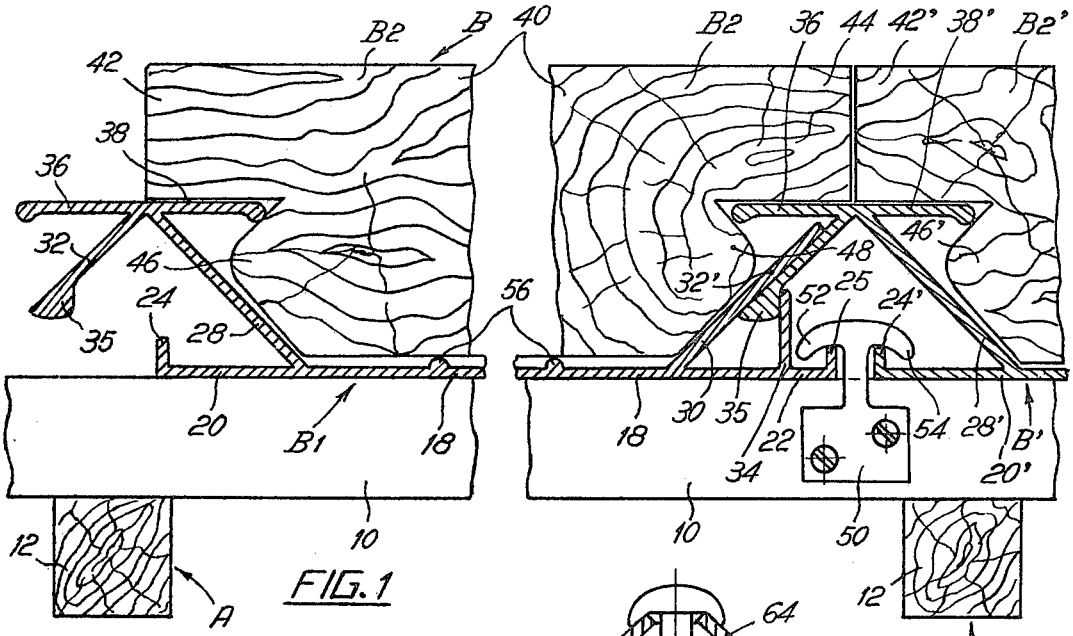
FIG. 1 is a cross-section taken parallely to the roof top and showing some elements of the covering.
Figure 2:
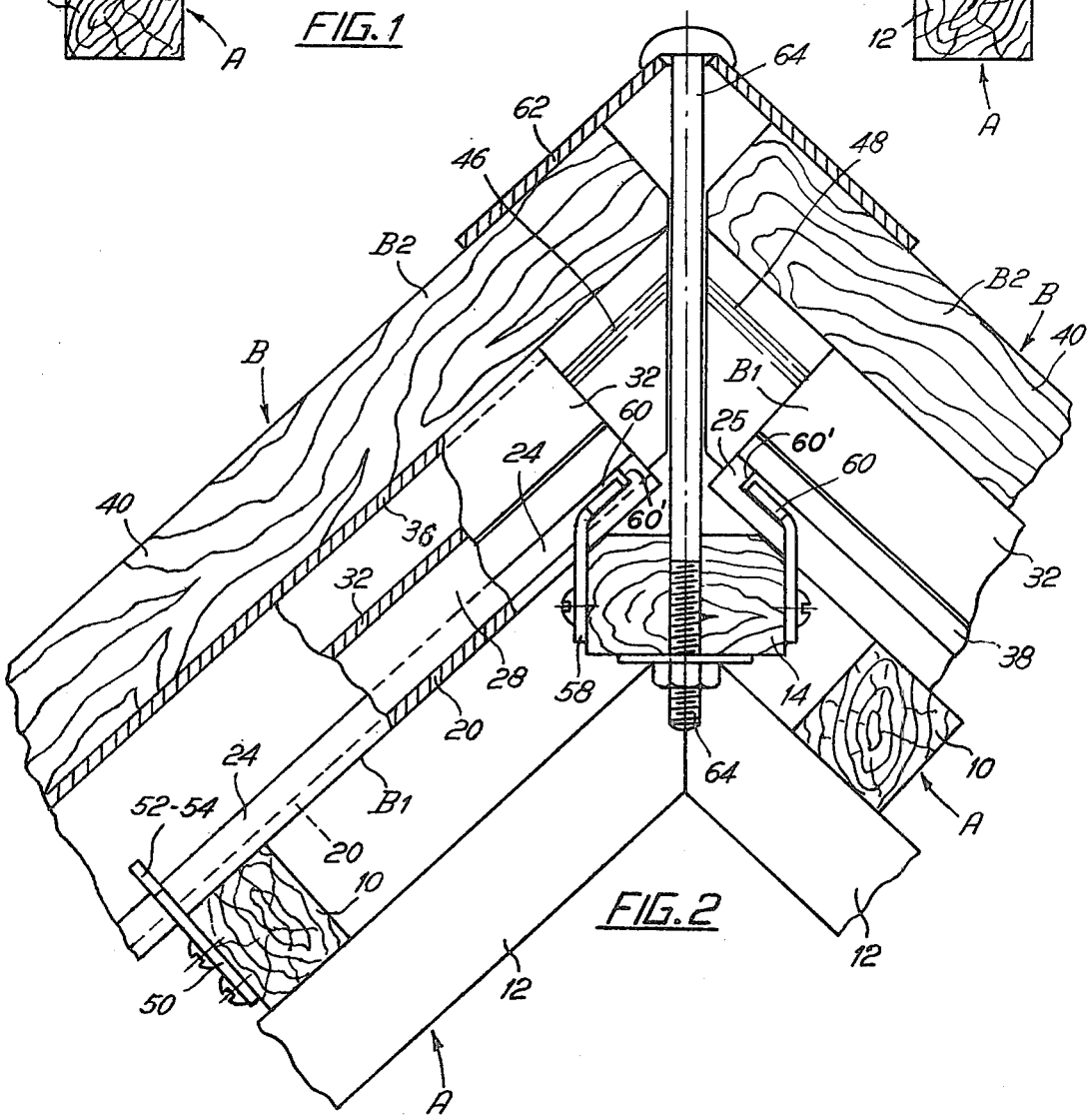
FIG. 2 is a cross section as taken through the top or ridge of the roof.

Referring to FIG. 1 showing the cross section of the plates B1, each said plate has a flat intermediate zone 18 which, at the longitudinal edges thereof, extends to form on either sides suitable-length fins 20 and 22 coplanar to one another and to said zone, effective to meet the requirements thereinafter illustrated. The longitudinal edges 24 and 25 of the planar fins 20 and 22 are suitably enlarged and, in the illustrated case, are cranked and upwardly directed. The plates B1, at the joints of the longitudinal edges of the zone 18 and those of the coplanar fins 20 and 22 provide for slanted fins 28 and 30 opposingly directed and upwardly extending to cover and pass over the coplanar fins 20 and 22.

Advantageously the slant formed by the fins 28 and 30 with the flat zone 18 is an angle of about 45° and said fins are of suitable resiliency with respect to the following description. The slanted fin 28 of the considered plate B1 is of greater width than the other plate 30 and the free edge thereof holds a complementary fin 32 the orientation and slant of this latter being substantially the same as in the slanted fin 30.

Referring to two adjacent plates B1 and B1' the fin 30 of the first abuts on the complementary fin 32' of the second plate B1' thereby providing for the connecting and continuity of the realized covering. In order to assure a mutual mechanical connecting of the plates B1, and in particular the tightly closing of the joints between the longitudinal edges of said plates, the horizontal fin 22 is provided, at the upper portion thereof, with a longitudinal rib 34 extending upwardly the free edge of said rib being provided with a shaped enlargement engaged by a tooth longitudinally formed on the complementary fin 32' of the considered plate B1'.

The arrangement and size of the complementary fins 32, edges 24 and 25 and ribs 34 are such as to allow for the coupling of these parts related to two adjacent plates, both by means of a resilient deformation and threading thereof.

The angle formed by the fins 28 and 32 is provided, at the upper corner thereof, with two coplanar and opposed strips 36 and 38 parallely extending to the flat zone 18 of the considered plate, whereas the free ends of said strips 36 and 38 are enlarged and suitably rounded to meet the requirements thereinbelow described.

The considered covering 8 is then completed by means of covering bodies B2 formed by parallelepiped blocks 40 and some opposed walls 42 and 44 of said blocks are provided with slots forming shaped ridges or ribs 46 and 48. These latter are resiliently housed in the slots formed by one side of the angled fin 30 and by the counterfin 36' related to the plate B1' adjacent to the considered plate.

In the illustrated case the opposed walls 42 and 44 of the parallelepiped blocks 40 form jointing surfaces extending from the top to the bottom of the roof.

The covering bodies B2 are made of the most suitable materials, such as metallic materials (zinc, copper, aluminium and alloys thereof), cement materials (concrete, conglomerates, asbestos-cement) and wood materials (wood and related conglomerates suitably processed), and said bodies have suitably shaped faces to meet the use requirements. Thus, for example the upper faces of said bodies may be slotted or ridged. In the case of metallic bodies B2, they may be made of metal sheet and of box structure.

The plates B1 are fixed to the frame A of the roof by means of anchoring plates 50 as provided with hook pairs 52,54 the lower edges of which engage with the longitudinal edges 25 and 24 of the two adjacent plates B1 and B1'.

In order to prevent water from accumulating between the plates B1 and the blocks B2, the intermediate zones of said plates are provided, at the upper faces thereof, with ridges or ribs 56 which form between the considered parts a gap terminating at the lower end thereof in the gutter of the roof.

The covering embodiment according to the present invention will be now described, as an example only, with reference to the considered roof. At first the supporting frame A is prepared in the conventional way and then the plates B1 are cut to the proper length by locating said plates on said frame. More precisely two of the plates B1 and B1' are brought near to one another to engage, by a resilient forcing operation, the end of the complementary fin 32' in the slot formed by the slanted fin 30 and the enlarged edge of the rib 34 as related to the plate B1. Due to the resiliency of these parts, the fins 30 and 32' engage to one another in an abutting relationship and the tooth 35 of the complementary fin 32' snap engages the shaped edge of the rip 34 to provide the connecting and thus assuring the parallelism and spacing of the longitudinal edges 25 and 24' of two adjacent plates B1 and B1'. The edges 25 and 24 of the complementary fins 22 and 20' form a longitudinal slot through which the pairs of arms 52–54 of the plates 50 are introduced. These latter are then rotated through 90° thereby engaging said arms 52–54 with the cranked edges 25 and 24' and, prior to the fixing thereof a downwardly directed force is applied. Then the plates 50 are fixed by means of nails or the like to the beams 10 of the base frame A of the roof. The pulling action by the plates 50, in addition to clamp the plates B1 and B1' against the base frame A, also causes the two adjacent plates B1 and B1' to slide to one another thus assuring the adhesive abutting of the fins 30 and 32. In this manner between the longitudinal edges of two adjacent plates a tight connecting is obtained, said connecting being efficient even if great thermal expansions occur, due to the inherent resiliency of the two fins 30 and 32'.

If requested by particular needs, the joints formed by the fins 30 and 32' may be provided with gaskets or sealing mastics.

In order to longitudinally fix the plates B1 and prevent said plates from downwardly sliding, at or near to the ends of said plates B1 anchoring members are provided consisting of plates 58, similar to the plates 50 and terminating with angled fins 60 engaged with notches provided at the cranked edges of the fins 20 and 22. The plates 58 are then fixed, in a known manner, to the top beam 14 of the frame A.

The thus installed plates B1 form a structure which is provided, at the upper portion thereof, with parallel slots extending from the top to the base of the roof. Subsequently the covering B consisting of the covering bodies B2 is installed. The ribs 46 and 48 formed in the opposed walls 42, 44 are anchored to the underlaying plates B1 by inserting and resiliently engaging said ribs in the slots formed by the pins 28–38 and 30–36. During this operation, the complementary fins 38 and 36 are flected downwardly and as they pass the crests of the ridges 46, 48 they are snap engaged in the slots formed above said ridges and in the opposed walls 42 and 44 of the considered bodies, thereby these latter are resiliently held by the considered plates B1.

The two flaps of the thus formed covering are then connected by a top element, consisting of an angle 62 the sides of which engage the top bodies B2. This angle is anchored by bolts 64 to the roof frame A.

Obviously the covering installing method according to the present invention may provide for a preliminary connecting of the bodies B2 to the plates B1 and the composite bars or rods thus obtained are easily installed in the above described manner, since the anchoring plates 50 may be fixed to the beams 10 of the base frame A.

In the carrying out of the invention, the making and constructional details may vary without departing from the scope of the invention.

I claim:

1. Covering for a roof or wall structure for buildings in general, consisting of elements mutually coupeable and able to be connected to the supporting frame of the structure, characterized by a plurality of parellely located plates (B1) having longitudinal edges (24, 25) extending from the bottom to the top of the roof or wall structure and provided, at least along a portion of the longitudinal edges (20, 22) thereof, with means (30, 34, 32') for a mutual connecting and tight closing and with fixed-joint type members (36, 38) extending as a ridge along the longitudinal edges of said plates and effective to hold covering bodies (B2) against said plates, further characterized in that the plates (B1) terminate at the longitudinal ends thereof with coplanar fins (20, 22) therewith anchoring members clamping said plates against the base frame (A) engage.

2. A covering according to claim 1, further characterized in that said plates (B1) are provided, along the longitudinal edges thereof, with pairs of parallel fins (28–38, and (30–36), at least partly resiliently spring biassed, suitably slanted and forming opposed slots engaged by ridges (46, 48) formed in the opposed walls (42, 46) of the covering bodies (B2).

3. Covering for a roof or wall structure for buildings in general, consisting of elements mutually coupeable and able to be connected to the supporting frame of the structure, characterized by a plurality of parallely located plates (B1) having longitudinal edges (24, 25) extending from the bottom to the top of the roof or wall structure and provided, at least along a portion of the longitudinal edges (20, 22) thereof, with means (30, 34, 32') for a mutual connecting and tight closing and with fixed-joint type members (36, 38) extending as a ridge along the longitudinal edges of said plates and effective to hold covering bodies (B2) against said plates, further characterized in that the plates (B1) terminate at the longitudinal ends thereof with coplanar fins (20, 22), and anchoring members (50) clamping said plates against the base frame (A).

4. Covering for a roof or wall structure for buildings in general, consisting of elements mutually coupeable and able to be connected to the supporting frame of the structure characterized by a plurality of parallely located plates (B1) having longitudinal edges (24, 25) extending from the bottom to the top of the roof or wall structure and provided, at least along a portion of the longitudinal edges (20, 22) thereof, with means (30, 34, 32') for a mutual connecting and tight closing and with fixed-joint type members (36, 38) extending as a ridge along the longitudinal edges of said plates and effective to hold covering bodies (B2) against said plates, further characterized in that at least one of the coplanar parallel fins (20, 22) of the plates (B1) is at the upper portion thereof provided with a longitudinal rib (34) parallel to and spaced from the slanted fin (30) to form a slot in which the free edge of the complementary fin (32) of the plate adjacent to the considered plate engages.

5. A covering, according to claim 4, characterized in that the free edge of the longitudinal rib (34) is enlarged and suitably shaped to engage a tooth (35) provided by the longitudinal edge of complementar fin (32).

6. Covering for a roof or wall structure for buildings in general, consisting of elements mutually coupeable and able to be connected to the supporting frame of the structure, characterized by a plurality of parallely located plates (B1) having longitudinal edges (24, 25) extending from the bottom to the top of the roof or wall structure and provided, at least along a portion of the longitudinal edges (20, 22) thereof, with means (30, 34, 32') for a mutual connecting and tight closing and with fixed-joint type members (36, 38) extending as a ridge along the longitudinal edges of said plates and effective to hold covering bodies (B2) against said plates, further characterized in that the longitudinal edges (24, 25) of the coplanary fins (20, 22) are upwardly bent and engaged by arm pairs (52, 54) of the anchoring plates (50) fixed to the supporting frame of the covering.

7. A covering, according to claim 6, characterized in that the arm pairs (52, 54) of the anchoring plate (50) have the lower edge thereof slanted and converging upwardly to bring near to one another two of the adjacent plates (B1, B1') and to clamp said plates against the supporting frame (A) and to abuttingly engage one of the slanted fins (30) against the opposed slanted fin (32') of the adjacent plate thereby allowing for a tight coupling of the said two plates.

8. Covering for a roof or wall structure for buildings in general, consisting of elements mutually coupeable and able to be connected to the supporting frame of the structure, characterized by a plurality of parallely located plates (B1) having longitudinal edges (20, 22) extending from the bottom to the top of the roof or wall structure and provided, at least along a portion of the longitudinal edges (20, 22) thereof, with means (30, 34, 32') for a mutual connecting and tight closing and with fixed-joint type members (36, 38) extending as a ridge along the longitudinal edges of said plates and effective to hold covering bodies (B2) against said plates, further characterized in that the upwardly bent edges (22, 24) of the coplanar fins (20, 22) are provided with notches engaging the arms (60) of anchoring plates (58) held by the supporting frame and effective to prevent the plates (B1) from longitudinally sliding.

9. A covering, according to claim 8 characterized in that the longitudinal intermediate zones (18) of the parallel plates (B1) are provided with slots or ridges effective to assure the sliding of the rain.

10. A covering according to claim 8 characterized in that the coplanar counter fins (36, 38) are of resilient nature and the edge thereof being enlarged and rounded thereby assuring a snap engaging of the said counterfins with fixed-joint slots formed in the opposed walls (42, 44) of the covering bodies (B2).

11. A method for making a covering for roof or wall structures and the like for buildings in general, the covering elements being held by a supporting frame, characterized in that it comprises the steps of parallely locating plates (B1) on said supporting frame (A) by abutting to one another longitudinal slanted fins (30,–32) of two adjacent plates (B1–B1'); inserting anchoring members (50) in slots formed by longitudinal edges of coplanar fins (20–22) of said two adjacent plates, engaging the opposed arms (52–54) of said anchoring members with said coplanar fin edges; then fixing to the frame supporting structure (A) said anchoring members to clamp the plates against said frame; and then applying covering blocks (B2) in the abutement delimitated by ridged edges of said plates.

12. A method according to claim 11, characterized in that the covering blocks (B2) are engaged with the plates (B1) by resiliently bending the coplanar counterfins (36, 38) to snap engage the edges of these latter in opposed slots (42–46, 44–48) of the opposed walls of said covering blocks.

13. A method according to claim 11, characterized by the steps of engaging the covering blocks (B2) with the plates (B1) and subsequently locating the thus prepared composite elements on the supporting frame (A) and then fixing said composite elements to said supporting frame by the anchoring member (50).

* * * * *